United States Patent [19]

Reber

[11] Patent Number: 4,724,782

[45] Date of Patent: Feb. 16, 1988

[54] DEVICE FOR GUIDING THE NEEDLE THREAD IN CENTRAL BOBBIN HOOK TYPE SEWING MACHINES

[75] Inventor: Lorenz Reber, Gaienhofen, Fed. Rep. of Germany

[73] Assignee: Fritz Gegauf Aktiengesellschaft Bernina-Nähmaschinenfabrik, Steckborn, Switzerland

[21] Appl. No.: 938,277

[22] Filed: Dec. 5, 1986

[30] Foreign Application Priority Data

Dec. 6, 1985 [CH] Switzerland ..... 5193/85

[51] Int. Cl.[4] ..... D05B 57/12

[52] U.S. Cl. ..... 112/192; 112/232

[58] Field of Search ..... 112/187, 192, 193, 232

[56] References Cited

U.S. PATENT DOCUMENTS

| | | | |
|---|---|---|---|
| 1,047,728 | 12/1912 | Baker et al. | 112/187 X |
| 2,989,017 | 6/1961 | Taketomi | 112/187 |
| 4,095,539 | 6/1978 | Johnson | 112/184 |
| 4,643,112 | 2/1987 | Sidler | 112/192 X |

FOREIGN PATENT DOCUMENTS

| | | | |
|---|---|---|---|
| 423990 | 1/1926 | Fed. Rep. of Germany . | |
| 642090 | 2/1937 | Fed. Rep. of Germany | 112/192 |
| 7016286 | 8/1970 | Fed. Rep. of Germany . | |
| 3342770 | 7/1984 | Fed. Rep. of Germany . | |

*Primary Examiner*—Wm. Carter Reynolds

*Attorney, Agent, or Firm*—Peter K. Kontler

[57] ABSTRACT

The takeup limb of each needle thread loop in a central bobbin hook type sewing machine is engaged by a kidney-shaped cam on the shuttle hook driver and by a projection on the housing for the hook while the takeup lever of the machine reduces the size of the loop. This ensures that the takeup limb is held and the loop is guided substantially during the entire interval of reduction of the size of the loop. The cam has a lobe with a groove for the takeup limb, and the projection of the housing engages the loop prior, during and subsequent to withdrawal of the takeup limb from the groove of the lobe.

15 Claims, 13 Drawing Figures

DEVICE FOR GUIDING THE NEEDLE THREAD IN CENTRAL BOBBIN HOOK TYPE SEWING MACHINES

CROSS-REFERENCE TO RELATED CASE

The device of the present invention constitutes an improvement over and a further development of the device which is disclosed in the commonly owned copending patent application Ser. No. 777,927 filed Sept. 19, 1985, now U.S. Pat. No. 4,643,112 granted Feb. 17, 1987. The disclosure of this application is incorporated herein by reference.

BACKGROUND OF THE INVENTION

The invention relates to improvements in devices for guiding the thread, particularly the needle thread, in so-called central bobbin (CB) or oscillating hook type sewing machines. In such machines, the shuttle hook oscillates in a substantially vertical plane.

An advantage of sewing machines which operate with CB hooks is that the needle thread loop is not twisted while it is being trained around the hook and around the bobbin case, as well as that the thread can readily pass between the hook and the shuttle driver finger, merely as a result of a reversal in the direction of movement of the hook and driver finger, without the need for any specially designed auxiliary equipment. Consequently, such hooks are normally less sensitive to changes in the tension of the thread and they can assist in the making of eye-pleasing uniform stitches.

Friction between the limbs of the needle thread loop develops in a CB hook type sewing machine the same as in machines employing other types of shuttle hooks. The magnitude of friction between the (work and takeup) limbs of the needle thread loop depends upon a variety of parameters including the diameters and types of threads, the selected type of stitching, the length of the loops, the width of the stitches, the speed of the sewing machine and others. Under certain circumstances, such friction can adversely affect the quality of the stitches.

The loop which is formed by the needle thread in a CB hook type sewing machine must completely surround the shuttle hook, the bobbin case and the supply of bobbin thread in the case. The loop is cast off shortly or immediately before the hook changes the direction of its movement, and the thus released loop is lifted by the takeup lever to be drawn into the work. As a rule, each upward movement of the takeup lever entails an upward movement of the front or work limb of the needle thread loop, i.e., of that limb which extends to the eye of the needle. The rear or takeup limb of the needle thread loop, which extends from the needle to the work and is located behind the hook, remains more or less passive. That portion of the bobbin thread which extends from the bobbin case to the underside of the work passes between the two limbs of the needle thread loop and normally does not interfere with a predictable reduction of the size of the needle thread loop. However, when the machine is set to make long and/or wide stitches, the needle penetrates behind that portion of the bobbin thread which extends from the bobbin case to the work during transition from a right downward stroke to a left downward stroke. This entails a looping of needle thread around the bobbin thread following the castoff from the hook with the result that additional friction develops in the region of the work limb of the needle thread loop. This, in turn, results in a more rapid upward movement of the takeup limb of the needle thread loop. The just described mode of operation is acceptable due to the fact that it does not appreciably affect the quality and/or appearance of stitches when the sewing machine is operated at a medium speed or at an elevated speed because the making of stitches takes place at frequent intervals and the inertia of the takeup limb of the needle thread loop is rather pronounced so that the takeup limb cannot react in response to development of additional friction with the work limb. However, frictional engagement between the limbs of the needle thread loop lasts longer, and the movements of such limbs relative to each other are slower, when the sewing machine is operated at less than average speed. At such time, the static component of friction is more pronounced and affects the thread much more than the dynamic component of friction. The upward movement of the takeup limb of the needle thread loop is too rapid so that the entire needle thread is not drawn all the way into the work and the work is provided with so-called slack or loose stitches. The making of slack stitches takes place at random so that they greatly affect the appearance of the product.

German Utility Model No. 70 16 286 discloses an oscillating hook type sewing machine wherein the needle thread loop is guided by a horn-shaped arm and by a holding finger which cooperates with the arm as soon as the loop is cast off by the circulating hook. This is intended to prevent the development of friction between the limbs of the needle thread loop by preventing the limbs from coming into contact with each other as well as to prevent an irregular or unpredictable reduction of the size of the needle thread loop. Such undertakings (see also U.S. Pat. No. 4,095,539) are satisfactory in sewing machines which employ circulating (rotary) looptakers. However, the teachings of these references cannot be incorporated in CB hook type sewing machines wherein the hook performs an oscillatory (back and forth) rather than a rotary movement.

German Pat. No. 423,990 proposes to provide the bobbin case in a sewing machine utilizing a circulating shuttle hook with a projecting nose serving to brake that (work) limb of the needle thread loop which extends toward the work until the other limb (which extends toward the source of the needle thread) has passed between the bobbin case and the retaining finger. A similar proposal is disclosed in German Offenlegungsschrift No. 33 42 770 which discloses a spring to be mounted on the shuttle driver in order to brake the takeup limb of the needle thread loop while the needle is caused to move upwardly. These proposals can be relied upon to prevent, at least to a considerable degree, the upward movement of the takeup limb of the needle thread loop. However, they also exhibit a serious drawback, namely that they effect an abrupt release of the needle thread loop which often leads to irregularities in the stitching pattern.

OBJECTS AND SUMMARY OF THE INVENTION

An object of the invention is to provide a novel and improved needle thread guiding device which ensures that the size of the needle thread loop can be reduced gradually.

Another object of the invention is to provide a device which can be used in a CB type hook sewing machine to ensure that the needle thread is positively guided during upward movement of the needle following a left downward stroke.

A further object of the invention is to provide a novel and improved needle thread guide which can be installed in existing CB hook type sewing machines.

An additional object of the invention is to provide a simple, compact and inexpensive needle thread guide which can ensure reliable guidance of the thread during several stages of each stitch making operation.

The invention is embodied in a sewing machine wherein a shuttle hook is mounted in a housing and receives motion from a driver means to perform oscillatory movements about a predetermined axis in a substantially vertical plane. The needle is reciprocable along a substantially vertical path and cooperates with a hook to convert the needle thread into a series of loops each having a plurality of limbs including a work limb and a takeup limb. The machine further comprises a bobbin case which is mounted on or in the hook and serves to confine a supply of bobbin thread, means (such as a customary takeup lever) for reducing the size of each loop during a predetermined stage of the respective oscillation of the hook, and novel and improved means for positively guiding at least one limb (particularly the takeup limb) of each loop during a reduction of the size of the loop. The means for guiding comprises a first holding member which can constitute a kidney-shaped cam, which is provided on the driver means and which has means (such as a lobe) for engaging the one limb of the loop, and a second holding member (e.g., a projection) provided on the housing and having means (e.g., a facet with a groove therein) for directing the one limb of the loop against the engaging means of the first holding member. The driver means has a surface facing the hook, and the cam extends beyond such surface. The lobe of the cam is preferably designed to deflect each loop during a predetermined stage of the corresponding oscillation of the hook, and the second holding member is preferably adjacent the apex of the housing, namely that portion of the housing which is nearest or at least close to the path of vertical or nearly vertical reciprocatory movement of the needle.

The preferably kidney-shaped cam includes two tips which flank its lobe and preferably merge gradually into the aforementioned surface of the driver means. The tips are disposed at a first distance from the surface of the driver means, and the lobe preferably comprises a part which is disposed at a greater second surface from the surface of the driver means. The lobe has a convex external surface which is or can be provided with a groove for the takeup limb of a loop, and such groove is preferably disposed in a plane which is at least substantially parallel to the surface of the driver means.

The cam can constitute a discrete part which is provided with a base, foot or a similar portion secured to (e.g., anchored in) the driver means.

The lobe and the hook preferably define an arcuate gap which is flanked by a concave surface of the hook and a complementary convex surface of the lobe.

The projection can be provided in a window or another suitable recess or opening of the housing, and such projection can be provided with a ramp for the loops and with a facet constituting the aforementioned retaining means and being substantially parallel to the axis of oscillatory movement of the hook. The facet can be provided with a groove which receives the takeup limb of a loop and is inclined with reference to the axis of oscillatory movement of the hook.

The novel features which are considered as characteristic of the invention are set forth in particular in the appended claims. The improved device itself, however, both as to its construction and its mode of operation, together with additional features and advantages thereof, will be best understood upon perusal of the following detailed description of certain specific embodiments with reference to the accompanying drawing.

Figure 7:
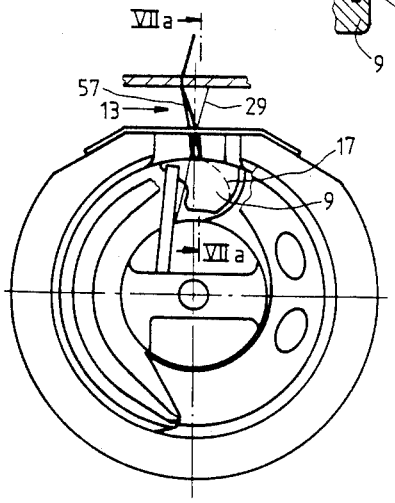
Figure 7A:
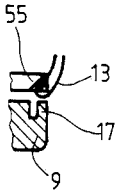
Figure 8:
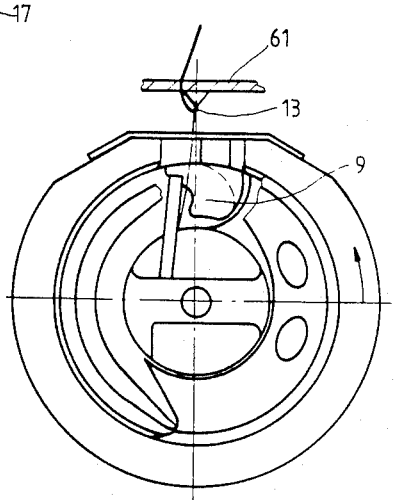
Figure 9:
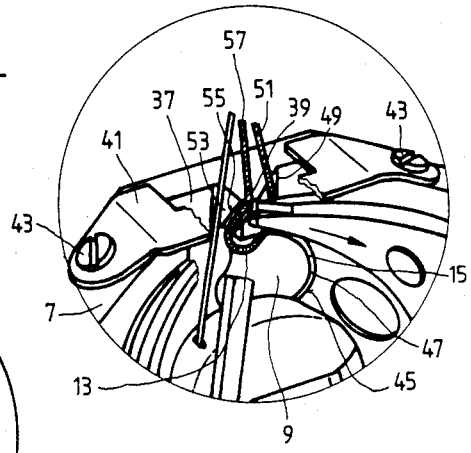
Figure 9A:
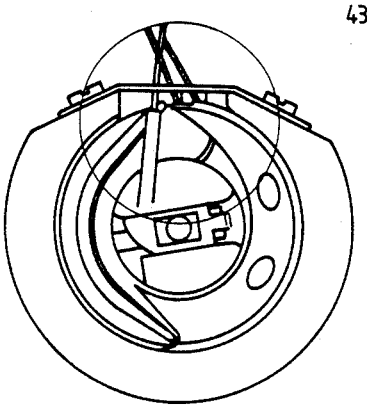

FIG. *7a* is a fragmentary sectional view as seen in the direction of arrows from the line VIIa—VIIa of FIG. 7 and shows the manner in which the bight of the needle thread loop is held by the cam on the shuttle driver;

FIGS. 8 and *9a* illustrate additional stages of oscillatory movement of the hook;

FIG. 9 is an enlarged perspective view of a detail within the solid-line circle in FIG. *9a;*

Figure 10:
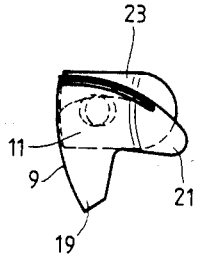

FIG. 10 is a front elevational view of the cam on the driver; and

Figure 11:
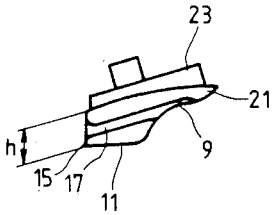

FIG. 11 is a side elevational view of the cam.

DESCRIPTION OF THE PREFERRED EMBODIMENTS

The drawing shows only those parts of a CB hook type sewing machine which are necessary for proper understanding of the invention. It is assumed here that the mode of operation of a conventional CB hook type sewing machine is known.

Figure 1:
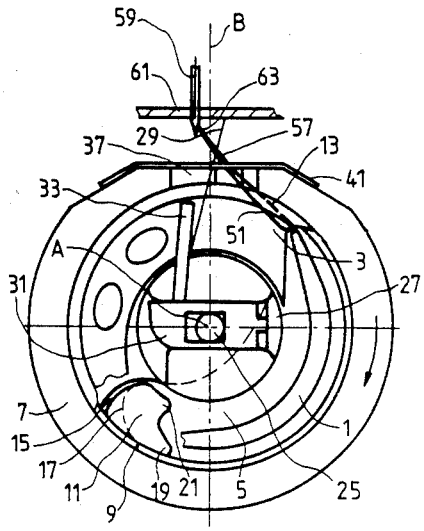
FIG. 1 is a front elevational view of the improved device, with the shuttle hook shown during the initial stage of its oscillatory movement in a clockwise direction to enlarge the size of the needle thread loop.

FIGS. 1 to *9a* show an annular housing 7 which surrounds an oscillatory shuttle hook 3 and a shuttle driver 1. A portion of the housing 7 is omitted to show the parts therein in a front elevational view such as is presented to a person upon removal of the adjacent portion of the casing and of the non-illustrated cover for the housing 7. The driver 1 has a dished surface 5 which faces the hook 3 and such driver receives motion in a manner known per se to oscillate back and forth about an axis A within the confines of the housing 7. The surface 5 of the driver 1 is adjacent a first holding member in the form of a kidney-shaped cam 9 which can constitute an integral portion of the driver or can be rigidly secured thereto by an adhesive, by one or more screws or similar fasteners, by being a form fit therein or thereon, or in any other suitable way. The cam 9 can be made of a metallic or plastic material and has a portion 11 (see also FIGS. 10 and 11) which is inclined with reference to a plane extending at right angles to the axis A. The part of maximum height h (FIG. 11) of the cam portion 11 (i.e., that part of the cam portion 11 which is disposed at a maximum distance from the surface 5 of the driver 1) is located inwardly of a thread-engaging lobe 15 which is disposed at the front end of the cam 9 during formation of a needle thread loop 13. The convex surface of the lobe 15 is formed with a groove 17 which is disposed in a plane at least substantially parallel to the surface 5 of the driver 1. The groove 17 has a central or median portion of greater depth and its depth decreases in directions toward the tips or ends 19 and 21 of the kidney-shaped cam 9. The tips 19, 21 merge gradually into the surface 5.

FIGS. 10 and 11 show a presently preferred cam 9 drawn to a larger scale. This cam comprises a base or foot 23 which is a tight fit (e.g., a press fit) in a complementary socket of the driver 1. This renders it possible to make the cam 9 independently of the driver 1 as well as to replace a defective cam 9 with a fresh cam or with a different cam when necessary.

The manner in which the hook 3 is mounted in the housing 7 for oscillatory movement about the axis A is known. The hook 3 comprises a mandrel 25 which carries a bobbin case 27 for a supply of bobbin thread 29. The case 27 is provided with a pivotable flap 31 which releasably engages the mandrel 25 to couple the case to the hook 3. The case 27 is further provided with an upwardly extending retaining finger 33 which is received in a suitable opening or recess of the housing 7 to hold the bobbin case against rotation. FIG. 9 shows that the housing 7 is formed with a recess or window 37 for a second holding member here shown as a projection or nose 39 which extends gradually toward the path of oscillatory movement of the hook 3. The projection 39 is formed with a groove 55 bounded by a surface which serves to direct the thread toward the lobe 15. The recess or window 37 is at least partially overlapped by a sheet-like thread guide 41 which is separably affixed to the housing 7 by screws 43 or other suitable fasteners.

The hook 3 is a cup-shaped body and is provided with a recess 45 bounded by a concave surface which is adjacent the cam 9 and extends in substantial parallelism with the outline (convex surface) of the lobe 15. This can be readily seen in FIG. 9 which further shows that the concave surface bounding the recess 45 and the complementary convex surface of the lobe 15 define a narrow clearance or gap 47 having a constant width of preferably less than one millimeter. The aforementioned part of the lobe 15 which has the height h is adjacent the gap 47.

FIG. 9 further shows that the right-hand section of the projection 39 in the window 37 of the housing 7 has a surface or ramp 49 which is inclined with reference to the plane of oscillatory movement of the hook 3. The left-hand section of the projection 39 has a surface or facet 53 having the aforementioned groove 55 which is inclined with reference to the axis A of oscillatory movement of the hook 3. The surface or facet 53 is or can be parallel to the axis A.

The manner in which the projection 39 and the cam 9 of the housing 7 influence the needle thread loop 13 is as follows:

When the needle 59 penetrates into the work 61 to the right of the center position (indicated by the phantom line B), i.e., when the needle 59 performs a right downward stroke, the limbs 51 and 57 of the needle thread loop 13 do not interfere with each other and/or with the bobbin thread 29. However, if the needle 59 performs a left downward stroke to enter the work 61 to the left of the line B, it advances to the left of and behind the bobbin thread 29 which extends from the bobbin case 27 to the work 61. Consequently, the needle thread loop 13 which is trained around the hook 3 is converted into a helix which is coiled tightly around the bobbin thread 29 and cannot be readily withdrawn into the work 61.

Figure 2:
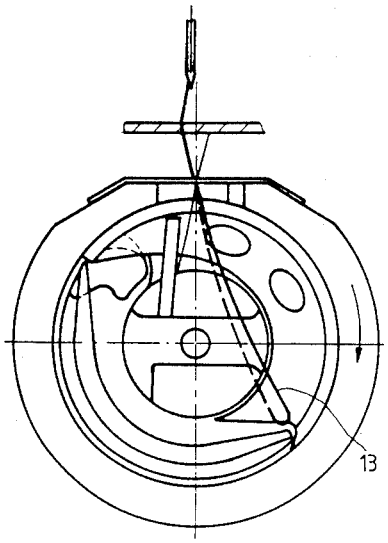
FIGS. 2 to 7 illustrate the structure of FIG. 1 during additional stages of oscillatory movement of the hook.
Figure 3:
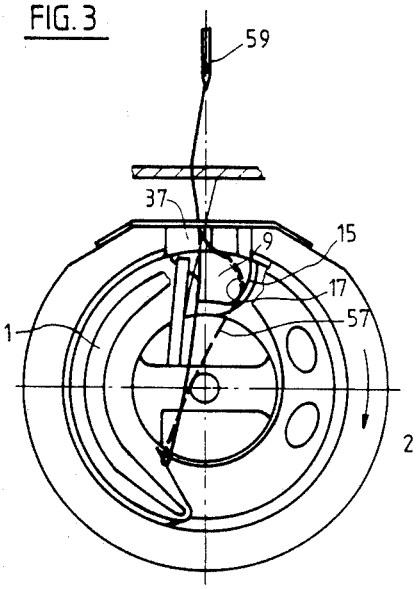

FIGS. 1 to 3 show that the needle thread 63 which is moved downwardly during left downward stroke of the needle 59 is engaged by the hook 3 while the latter turns in a clockwise direction (as indicated by the arrows) so that the hook 3 forms a progressively growing needle thread loop 13. The rear or takeup limb 57 of the loop 13 has penetrated into the groove 55 of the projection 39 and, due to inclination of the groove 55 with reference to the plane of oscillatory movement of the hook 3, is caused to enter the path of movement of the groove 17 on the lobe 15 of the cam 9. The front or work limb 51 and the rear or takeup limb 57 of the loop 13 respectively slide along the front and rear sides of the hook 3 while advancing downwardly as well as in a direction from the right to the left, as seen in FIGS. 1 to 3.

FIG. 3 shows the hook 3 at the point of reversal of the direction of its oscillatory movement; at such time, the loop 13 is cast off the hook 3 and the work limb 51 of the loop 13 is engaged by the takeup lever (see the U.S. Pat. No. 4,643,112 ) at a level above the eye of the needle 59 and is pulled upwardly toward the work 61.

During the formation of a loop 13, the cam 9 on the driver 1 also moves in a clockwise direction and, in the position of FIG. 3, is located at the apex below the recess 37 of the housing 7. The takeup limb 57 of the needle thread loop 13 extends from the work 61 downwardly and is received in the groove 55 of the projection 39 to be caused to enter the groove 17 shortly before the cam 9 reaches its end position. At such time, the groove 17 is disposed at the front end of the cam 9 and the surface surrounding such groove flexes the takeup limb 57 slightly to the right (see FIG. 3).

Figure 4:
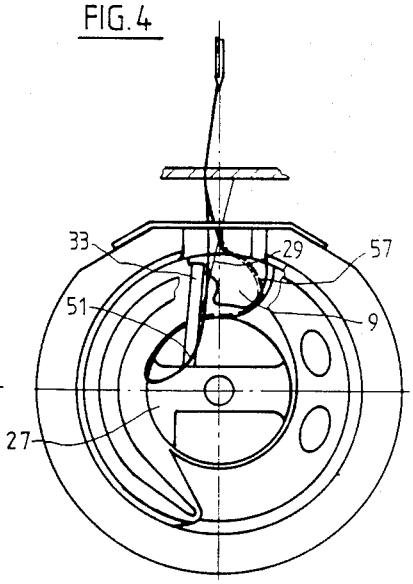
Figure 5:
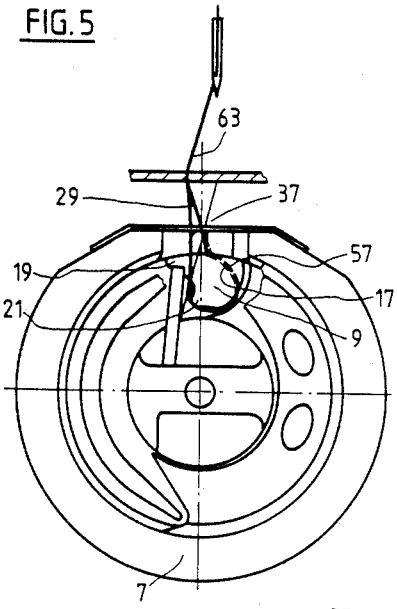
Figure 6:
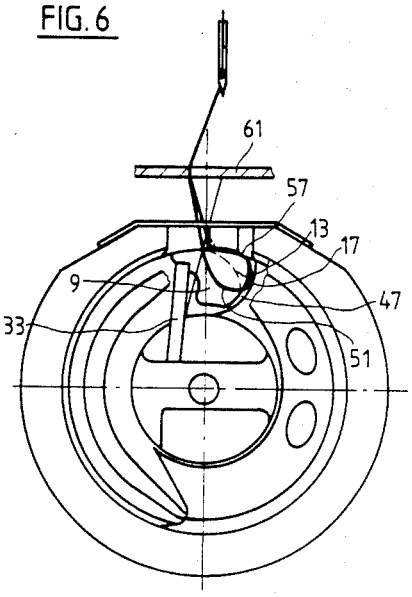

FIG. 4 shows the hook 3 in its end position subsequent to disengagement from the needle thread loop 13. The takeup limb 57 extends around the cam 9 and slightly to the left toward the bobbin case 27. At such time, the work limb 51 of the loop 13 is engaged by the retaining finger 33 to be kept at a distance from the bobbin thread 29 and is caused to move beyond the free end or tip of the finger 33 during the last stage of that interval when the takeup limb 57 surrounds the cam 9 (the finger 33 is provided on the bobbin case 27). This stage is shown in FIG. 5. The takeup limb 57 is received in the groove 17 of the cam 9 as well as in the groove 55 of the projection 39 from the instant on when it has entered the groove 17; the work limb 51 is looped around the bobbin thread 29 and slides over the tips 19 and 21 of the cam 9 as well as over the portion 11 of the cam against the lobe 15 (see FIG. 6). When the work limb 51 has moved sufficiently close to the lobe 15 of the cam 9, namely when the lower end or bight of the loop 13 is located at the shallow discharge or outlet end of the groove 17 (such discharge end merges practically without transition into the surface of the lobe 15), the needle thread loop 13 (and more specifically its takeup limb 57) is gradually withdrawn from the groove 17.

It will be seen that the upper section of the takeup limb 57, which extends from the cam 9, through the groove 55 and on the work 61, is held against sliding movement in an upward direction up to the very instant when the loop 13 becomes separated from the cam 9 (FIG. 7).

In the meantime, the size of the loop 13 has been reduced considerably but is still sufficient to permit for friction-free passage of the bobbin thread 29 during left downward movement of the needle 59. This is due to the fact that, during the last stage of reduction of the size of the needle thread loop 13, the takeup limb 57 of such loop is still located in the groove 55 at the left-hand side of the projection 39. The work limb 51 reaches the inclined surface (ramp) 49 as soon as the loop 13 is cast off the cam 9 and slides along the surface or ramp 49 toward the front end of the projection 39. At such time, the loop 13 becomes separated from the projection 39 (FIGS. 8 and 9) and is completely withdrawn into the work 61. It will be seen that the takeup limb 57 which extends from the work 61 is held up to the very last stage of reduction of the size of the loop 13 so that such reduction takes place exclusively as a result of upward movement of the work limb 51. It has been found that the improved device is capable of preventing any, even minimal, upward movement of the takeup limb 57, especially during left downward movement of the needle 59, i.e., frictional engagement (if any) between the limbs 51 and 57 does not suffice to entail any lifting or upward movement of the limb 57 during upward movement of the limb 51 for the purpose of reducing the size of the loop 13. This contributes to the making of eye-pleasing and uniform stitches which are free of slack. This is due to the fact that the loop 13 is not positively and accurately guided only during the very short last stage of reduction of the size of the needle thread loop 13. The loop 13 is held out of contact with the bobbin thread 29, and separation of the limb 57 from the cam 9 and projection 39 is gradual which also contributes to uniformity of stitches and to the absence of slack.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a sewing machine, the combination of a substantially vertically reciprocable needle for the needle thread; a housing; a shuttle hook mounted in said housing for oscillatory movement about a predetermined axis in a substantially vertical plane; driver means for oscillating said hook so that the hook and the needle cooperate in converting the needle thread into a series of loops each having a plurality of limbs; a bobbin case mounted on said hook and arranged to confine a supply of bobbin thread; means for reducing the size of each loop during a predetermined stage of the respective oscillation of said hook; and means for positively guiding one limb of each loop during a reduction of the size of the loop, including a first holding member provided on said driver means and having means for engaging said one limb, and a second holding member provided on said housing and having means for directing said one limb against said first holding member.

2. The combination of claim 1, wherein each loop has a work limb and a takeup limb and said holding members are arranged to engage the takeup limb of each loop.

3. The combination of claim 2, wherein said driver means has a surface facing said hook and said first holding member extends beyond said surface.

4. The combination of claim 2, wherein said first holding member comprises a cam arranged to deflect each loop during a predetermined stage of the respective oscillation of said hook.

5. The combination of claim 4, wherein said needle is reciprocable along a predetermined path and said second holding member is adjacent said path.

6. The combination of claim 4, wherein said cam has a lobe which constitutes said engaging means and two tips flanking said lobe, said driver means having a surface facing said hook and said cam being adjacent said surface, said tips being disposed at a first distance from said surface and said lobe having a part which is disposed at a greater second distance from said surface.

7. The combination of claim 6, wherein said cam has the shape of a kidney.

8. The combination of claim 6, wherein said lobe has a groove for the takeup limbs of the loops, said groove being disposed in a plane which is substantially parallel to said surface.

9. The combination of claim 6, wherein said tips merge gradually into said surface of said driver means.

10. The combination of claim 6, wherein said lobe and said hook define an arcuate gap.

11. The combination of claim 10, wherein said hook has a concave surface adjacent said gap, said lobe having a convex surface adjacent said gap and complementary to said concave surface.

12. The combination of claim 2, wherein said first holding member comprises a discrete cam having a portion which is secured to said driver means.

13. The combination of claim 2, wherein said housing has a window and said second holding member comprises a projection in said window.

14. The combination of claim 13, wherein said projection has a ramp for the loops and said retaining means comprises a facet which is substantially parallel to the axis of oscillatory movement of said hook.

15. The combination of claim 14, wherein said facet has a groove for the takeup limb of a loop, said groove being inclined with reference to said axis.

* * * * *